United States Patent [19]

Teague, Jr. et al.

[11] 4,179,765

[45] Dec. 25, 1979

[54] NUTATING DEVICE WITH PROVISION FOR UTILIZATION OF MOTIVE FLUID

[76] Inventors: Walter D. Teague, Jr., Tweed Blvd., Nyack, N.Y. 10960; Arthur T. Sempliner, 37-04 Van Nostrand Pl., Douglaston, N.Y. 11363

[21] Appl. No.: 888,137

[22] Filed: Mar. 20, 1978

Related U.S. Application Data

[63] Continuation-in-part of Ser. No. 827,625, Aug. 25, 1977, which is a continuation-in-part of Ser. No. 848,807, Nov. 7, 1977.

[51] Int. Cl.[2] ..... A46B 13/06

[52] U.S. Cl. ..... 15/22 R; 128/47; 173/64

[58] Field of Search ..... 15/22 R, 22 C; 51/119, 51/58; 128/47, 50; 173/59, 64, 73, 79, 168, 169, DIG. 4; 418/49-53

[56] References Cited

U.S. PATENT DOCUMENTS

| | | | |
|---|---|---|---|
| 1,005,024 | 10/1911 | Griner | 128/47 |
| 1,224,008 | 4/1917 | Nelson | 128/47 X |
| 1,717,501 | 6/1929 | Fisher | 128/46 |
| 2,244,539 | 6/1941 | Krueger | 418/50 |
| 3,480,981 | 12/1969 | Murov et al. | 15/22 R |
| 3,906,573 | 9/1975 | Crawford | 15/22 R |
| 3,968,789 | 7/1976 | Simoncini | 128/49 |

*Primary Examiner*—Edward L. Roberts
*Attorney, Agent, or Firm*—Mandeville and Schweitzer

[57] ABSTRACT

In a nutating action appliance including a motor housing and wobble plate arranged therein, a novel arrangement to divert a portion of the motive fluid to a motor-driven utilization device. The wobble plate includes an output rod which is connected to the utilization device. In accordance with the invention, a continuous fluid passage-forming means is provided in the output rod and utilization device and communicates with the main motive fluid supply line for the appliance. Discharge ports are arranged in the working end of the utilization device and are connected to the passage-forming means whereby a portion of the motive fluid is diverted from the main supply line directly to the working surface through the main functional components of the appliance. Provision may be made for a continuous or pulsating discharge of the fluid to the working surface.

18 Claims, 4 Drawing Figures

NUTATING DEVICE WITH PROVISION FOR UTILIZATION OF MOTIVE FLUID

RELATED APPLICATIONS

This application is a continuation-in-part of applications Ser. No. 827,625, filed Aug. 25, 1977 and Ser. No. 848,807, filed Nov. 7, 1977 and is closely related in subject matter to our following co-pending applications, all directed to nutating action devices and improvements thereon: Ser. No. 848,806, filed Nov. 7, 1977.

BACKGROUND AND SUMMARY OF THE INVENTION

The present invention is related to a fluid-driven, nutating action appliance, and more particularly to novel arrangements therein for utilizing a portion of the motive fluid for discharge through a utilization device and application to a working surface.

Generally, in a nutating action motor, a housing contains a sphere mounted for universal movement relative thereto, within certain angular limits. An annular plate is integral with or carried by the sphere, and an output device in the form of a shaft or rod extends from the sphere along the axis extending through the center thereof and at right angles to the annular plate to form a wobble plate. The annular plate is slotted at one side and straddles a separating plate which divides the housing in which the sphere is contained. In the operation of the motor, water flows into the housing on one side of the separating plate, travels in a circular path around the housing and leaves through an exit port on the opposite side of the separating plate. Means are provided to maintain a predetermined angularity between the axis of the output rod and the central axis of the housing. Thus, when water is admitted into the housing and travels around it to reach the discharge port, it pushes against the canted wobble plate which assumes progressively changing tilt angles as a result of the continuous water flow. Consequently, the output shaft is moved in an orbital manner which may be mechanically transferred to a utilization device.

A novel and useful nutating action appliance is taught by the applicants' co-pending application Ser. No. 827,625, filed Aug. 25, 1977. In accordance with the invention of said co-pending application, the utilization device is mounted directly upon the output rod of the nutating action motor such that the utilization device itself operates with a nutating, orbital motion. The result is a highly efficient and useful working action for the device, which is a combination of orbital movement and tilting, without rotation. Due to the direct driving connection between the utilization device and the output shaft, the motor may be of extreme simplicity in design. Yet, the device of said co-pending application produces a highly desireable form of relatively low speed, high torque movement, ideally suited for a variety of uses in and around a household workshop or similar work area.

Another example of a nutating action appliance is disclosed in the applicants' co-pending application Ser. No. 848,807, filed Nov. 7, 1977. In accordance with the teachings of said co-pending application, a power toothbrush or the like is characterized particularly by the fact that the toothbrush element is driven in an orbital path. As a specific feature of that invention, the output rod of the nutating action is connected to a wobble shaft through a form of universal drive joint. The wobble shaft is mounted in a handle-forming casing in such a manner that it may be pivoted at a point at which the wobble shaft is secured to the casing. Consequently, the orbital motion of the output rod will be transmitted directly to the wobble shaft to impart an orbital movement to the toothbrush.

In each of the above-described nutating action appliances, it is highly desireable to provide for the application of a fluid to the working surface to facilitate an improved cleaning, scrubbing or brushing action by the utilization device. Accordingly, it is a primary objective of the present invention to provide a novel arrangement of passage-forming means to divert a portion of the fluid used to drive the nutating action motor directly through the nutating action motor and the utilization device, to the working surface.

As a specific feature of the present invention, a passage is in communication with the main supply line for the motive fluid and extends to an opening in the motor housing arranged adjacent one of the bearing supports for the sphere of the wobble plate. A plenum cavity is formed by the housing and the bearing support and communicates with the opening whereby a portion of the motive fluid is directed above the sphere. The fit between the sphere and the bearing support is sufficiently tight to minimize leakage out of the cavity or from the chamber of the housing into the cavity. The output rod of the wobble plate is of a hollow, tubular configuration and one end thereof opens to the plenum. In this manner, a portion of the motive fluid, diverted from the main supply line, will flow through the output rod and to the utilization device which is directly connected to the output rod, as described. A hollow internal section of the utilization device communicates with the end of the output rod and is connected to exit ports arranged at the working end of the device. The fluid will then be discharged through the exit ports directly to the working surface.

The plenum cavity may be wide so that the hollow portion of the output rod is in fluid communication with the plenum cavity for the entire orbital path of the output rod. Alternatively, the plenum cavity may be of smaller dimensions such that the output rod and plenum cavity are in flow communication for a predetermined fraction of the complete orbital path of the output rod. In this manner, the portion of the motive fluid diverted from the main supply line may be discharged through the utilization device in a continuous or pulsating flow.

For a better understanding of the above and other features and advantages of the invention, reference should be made to the following detailed description of preferred embodiments and to the accompanying drawings.

DETAILED DESCRIPTION OF PREFERRED EMBODIMENTS OF THE INVENTION

Figure 1:
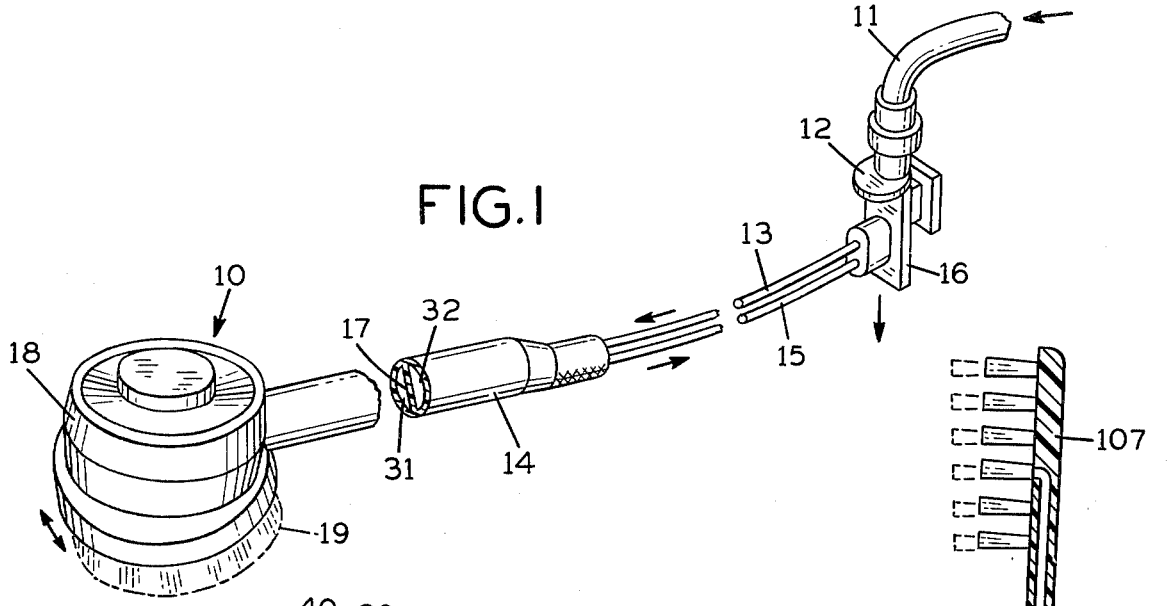
FIG. 1 is a perspective view of a nutating action appliance incorporating features of the present invention.
Figure 2:
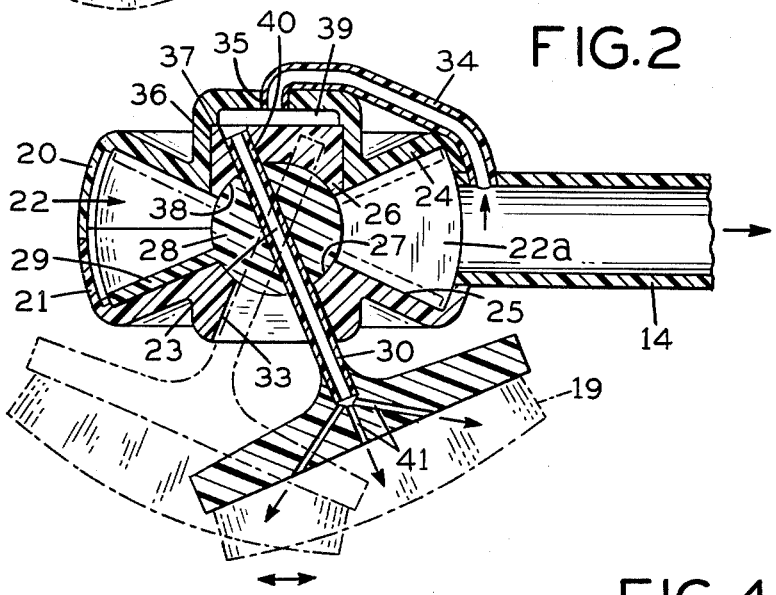
FIG. 2 is a partial cross-sectional view of the appliance of FIG. 1 illustrating the details of one embodiment of the present invention.

Referring now to the drawings and initially to FIGS. 1 and 2 thereof, there is illustrated a nutating action appliance indicated generally by the reference numeral 10. The appliance 10 is built substantially in accordance with the disclosure of the applicants' co-pending application Ser. No. 827,625, filed Aug. 25, 1977 which is hereby expressly incorporated by reference. A source of motive fluid, for example a household water faucet 11, is connected to an attachment 12 which directs the water to a section of tubing 13 communicating with a handle 14 of the appliance 10. A second section of tubing 15 extends between the handle 14 and faucet attachment 12 and transports the water exiting from the appliance 10 to an outlet 16 whereby the water may be discharged into a sink (not shown).

To advantage, the handle 14 is of a hollow construction and includes a dividing wall 17 to form two channels 31, 32 for transport of water. The tubing 13 is connected to the handle 14 at one side of the wall 17 to the channel 31 and the tubing 15 is connected at the other side to the channel 32. The arrangement provides a means for ingress and egress of a driving fluid to the nutating action motor housed in the appliance 10, as will appear. Integral with the handle 14 is a casing 18 enclosing the nutating action motor and mounting a utilization device, as for example, a brush 19. The appliance may be conveniently constructed of rugged molded plastic.

Referring now to FIG. 2, there is illustrated the internal structure of the casing 18. The casing 18 comprises an upper section 20 and lower section 21, which are joined in a mating relation and define a chamber 22. The chamber 22 is essentially a body of revolution with a center of curvature at point 23. The sections 20, 21 are each formed to include inwardly extending, conical portions 24, 25 respectively. The conical portion 25 terminates in a spherically contoured bearing seat 27. The conical portion 24 includes a cylindrical opening 36 which is concentric about an axis passing through the center point 23. A rotatable bearing insert 26 is received in the cylindrical opening 36 and is seated against an integral shoulder 37 of the opening 36. The end of the bearing insert 26 facing the interior of the chamber 22 forms a spherical bearing seat 38. A sphere 28 is mounted for universal movement within predetermined limits between the bearing seats 27, 38.

An annular disc 29 is integral with the sphere and together they form a wobble plate. An output rod 30 is mounted in a perpendicular relation to the plane of the annular disc 29 and passes through the center point 23. The output rod 30 extends into a moving fit with an angularly disposed recess 40 formed in the bearing insert 26 to maintain the wobble plate in a canted position. In accordance with well known construction for nutating action motors, the disc 29 includes a slot (not shown) which straddles a dividing plate 22*a* separating the chamber 22 into two sections. The channel 31 communicates with the chamber 22 on one side of the dividing plate for ingress of the driving water. The water flows around the chamber 22 and exits through the channel 32 which communicates with the chamber 22 on the opposite side of the dividing plate.

In the operation of the nutating action motor, the force of the water flowing through the chamber 22 will push against the wobble plate causing it to assume progressively changing tilt angles with respect to the central axis of the chamber 22. Consequently, the output rod 30 will be moved through an orbital motion with the ends thereof circumscribing a circle. The bearing seat 27 includes a conical opening 33 to permit the output rod 30 to extend outside the casing 18. The brush 19 is directly connected to the end of the rod 30 and therefore follows an orbital path without rotation for a highly effective cleaning operation.

In accordance with the invention, a tube 34 extends between the interior of the handle 14 and an opening 35 formed in the upper section 20 of the casing 18. In this manner, a portion of the water will be diverted to the interior of the casing 18 and above the bearing insert 26 to a cylindrical cavity 39 defined by the spacing between the bearing insert 26 and upper housing section 20. In the device of FIGS. 1–2, the cavity 39 occupies the entire width of the opening 36. The output rod 30 is formed of a hollow tube construction, and the end thereof within the recess 40 is in flow communication with the cavity 39. The rod 30 will be in communication with the cavity 39 for its entire orbital path. Consequently, the diverted water will flow continuously through the tube 34, cavity 39 and rod 30 to the brush 19 mounted at the opposite end of the rod 30. Within the brush 19 is a plurality of fluid paths 41 communicating with the open end of the tubular rod 30 and running to various parts of the brush 19. The paths 41 discharge the water directly into the brush and onto the surface contacted by the brush 19 to aid in the cleaning action of the appliance.

Figure 3:
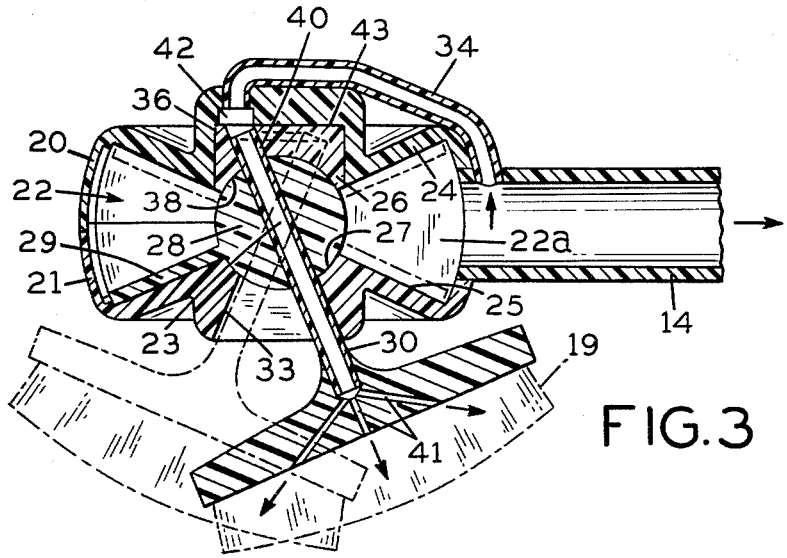
FIG. 3 is a partial cross-sectional view of the appliance of FIG. 1 and illustrating another embodiment of the present invention.

In the embodiment of the appliance shown in FIG. 3, provision is made for periodic or pulsating discharge of water through the brush 19. Unlike the embodiment of FIG. 2, the FIG. 3 device does not incorporate a wide cavity above the bearing insert 26. Rather, the tube 34 discharges into a small chamber 42, which may be in the form of a small diameter recess, or maybe slightly arcuately elongated, depending upon the particular requirements of the end use. In any case, it is intended that the recess be in communication with the open upper end of the output rod 30 only during a predetermined fraction of the complete orbital path of the output rod 30. Thus, during at least part of the rotational cycle of the bearing insert 26, preferably most of it, the surface 43 of the bearing insert 26 functions as a valve to prevent flow of water from the chamber 42 into the upper end of the output rod 30. However, during a selected portion of the orbital motion of the output rod 30, the open end of the output rod 30 is in alignment with the chamber 42 and water is permitted to flow momentarily through the tubular output rod 30 to the fluid paths 41 of the brush 19. This arrangement produces a pulsating outflow of water through the brush 19 to the working surface.

Figure 4:
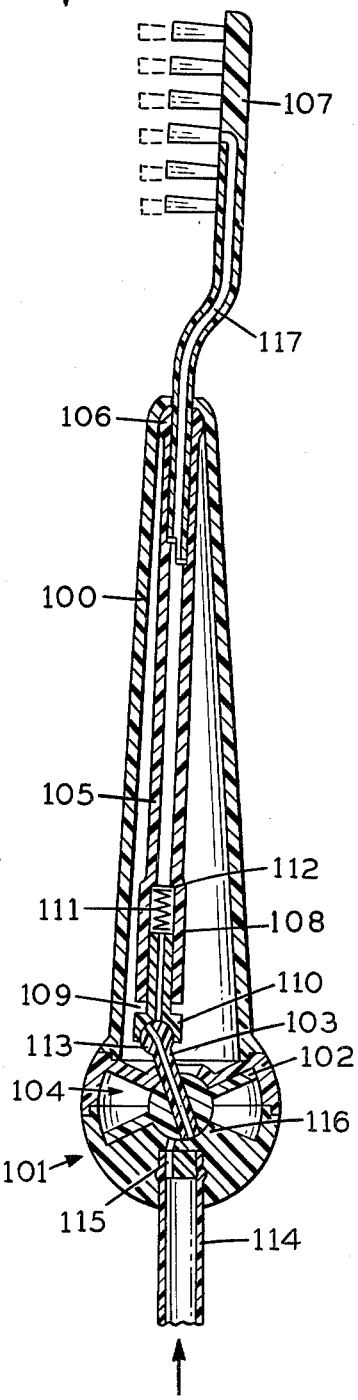
FIG. 4 is a cross-sectional view of a nutating action toothbrush appliance incorporating the present invention.

Referring now to FIG. 4, the output of the nutating motor is transmitted directly to a toothbrush appliance. The toothbrush appliance is built substantially in accordance with the applicants' co-pending application Ser. No. 848,807, filed Nov. 7, 1977 and which is hereby expressly incorporated by reference. A main handle-forming casing 100 houses a nutating action motor 101 at the lower end thereof. The motor 101 includes a wobble plate 102 and tubular output rod 103 arranged within an internal chamber 104 substantially as described in relation to the embodiments of FIGS. 1–3. A tubular wobble shaft or hollow force-transmitting member 105 includes a rounded end 106 which is seated at the forwardmost end of the casing 100. This arrangement permits a tubular wobble shaft 105 to be pivoted about the rounded end 106. A toothbrush appliance 107 is slidably received within the tubular wobble shaft 105 through an opening formed at the forwardmost end of the casing 100. The opposite end of the tubular wobble shaft 105 includes an enlarged portion 108 in which is received a hollow member 109 arranged to protrude beyond the end of the wobble shaft 105. The hollow member 109 includes a socket 110 mounted at the protruding end thereof. A spring 111 is arranged within the enlarged portion 108 of the tubular wobble shaft 105 and acts between the member 109 and an internal shoulder 112 of the shaft 105. The spring 111 will urge the socket 110 into engagement with a bearing ball 113 mounted at the end of the output rod 103 to form a universal drive joint between the output rod 103 and wobble shaft 105. The spring 111 will serve to normally maintain the wobble plate 102 of the motor 101 in a fully canted position, while providing for pressure relief in the event of a stall or overload.

In accordance with the invention, a section of double tubing 114 communicates with the lower end of the casing 100 and communicates with the chamber 104 in the manner described with reference to FIGS. 1 and 2. A passage 115 communicates with the inlet side of the tubing 114 and opens at a spherical bearing seat 116 of the chamber 104. The passage 115 is arranged such that the tubular portion of the output rod 103 is in alignment therewith during a portion of its orbital path. At that point, the tubular portion of the output rod 103 is also in alignment with the interior of the hollow member 109 providing a continuous fluid path from the tubing 114 through the passage 115, output rod 103, member 109 and tubular wobble shaft 105 to the toothbrush appliance 107. The toothbrush appliance includes a fluid path 117 communicating with the hollow interior of the tubular wobble shaft 105 and arranged to discharge the fluid through the bristles of the toothbrush appliance 107 to the teeth. When the passage 115 is not in alignment with the tubular output rod 103, the wobble plate will act as a valve to close the passage 115, as is clearly illustrated in FIG. 4. As will be understood, this arrangement produces a pulsating outflow of water to the teeth during operation of the appliance.

In any of its various forms, the passage-forming means of the present invention is of an extremely simplified nature utilizing already existing components of a nutating action appliance as conduits for diverting a portion of the motive fluid to the utilization device. The unique arrangement of providing a hollow output shaft between a diverting tube for the motive fluid and discharge openings in the utilization device is a most efficient and direct means for applying a fluid to the working surface. Thus, the present invention provides a highly advantageous improvement for a nutating action appliance. When incorporated with the devices disclosed in the above-mentioned related applications, a nutating action appliance is provided which is adaptable to low cost, high-volume manufacture, so as to be highly suitable for merchandising as a high volume home appliance.

It should be understood of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. In a fluid-driven nutating action appliance including a motor housing and a wobble plate mounted in said motor housing for universal tilting movement within predetermined limits, means for diverting a portion of the motive fluid to a utilization device, which comprises (a) an output element carried by said wobble plate,
(b) a utilization device associated with said output element,
(c) flow passage means in said motor housing connected to a remote source of motive fluid and communicating with the interior of said motor housing to drive said wobble plate,
(d) continuous passage-forming means arranged in said output element and said utilization device, and
(e) a plurality of discharge ports arranged in said utilization device,
(f) said passage-forming means communicating at one end thereof with said flow passage means and at the other end thereof with said discharge ports whereby a portion of the motive fluid is diverted through the passage-forming means and discharged through the ports directly to the working surface contacted by said utilization device.

2. The means for diverting a portion of the motive fluid to a working surface as set forth in claim 1, further characterized by (a) said output element comprising a rod-like hollow tube,
(b) one end of said rod-like hollow tube communicating with said flow passage means.

3. The means for diverting a portion of the motive fluid to a working surface as set forth in claim 2, further characterized by (a) said motor housing having a chamber therein communicating with said one end of the rod-like hollow tube, and
(b) said flow passage means communicating with said chamber.

4. The means for diverting a portion of the motive fluid to a working surface as set forth in claim 3, further characterized by (a) said rod-like hollow tube having at least one end projecting out of said motor housing,
(b) said utilization device being mounted on the projecting end of said output element, and
(c) said discharge ports of the utilization device being in flow communication with the hollow tube of the output element.

5. The means for diverting a portion of the motive fluid to a working surface as set forth in claim 3, further characterized by (a) said chamber being of a size and shape to communicate with said rod-like hollow tube during a limited portion only of the orbital cycle of said output element.

6. In a fluid-driven, nutating action appliance, including a motor housing and a wobble plate mounted in said motor housing for universal tilting movement within predetermined limits, means for discharging a fluid under pressure to a utilization device, which comprises (a) a rod-like output element carried by said wobble plate,
(b) a utilization device mechanically connected to said output element, (c) passage-forming means arranged in said output element and said utilization device, and
(d) means for supplying fluid under pressure to said passage-forming means.

7. The means for discharging a fluid under pressure to a working surface as set forth in claim 6, further characterized by
(a) discharge ports in said utilization device communicating with said passage-forming means and opening to the working surface contacted by the utilization device.

8. The means for discharging fluid under pressure to a working surface as set forth in claim 6, further characterized by
(a) said output element comprising a hollow tube,
(b) said utilization device including a hollow tubular force transmitting member mechanically connected to said hollow tube,
(c) said passage-forming means comprising a continuous tubular flow path formed by said output member and said force transmitting member,
(d) said means for supplying fluid under pressure communicating with said hollow tube whereby fluid under pressure may be transported through said hollow tube to the force transmitting member of the utilization device.

9. The means for discharging fluid under pressure to a working surface as set forth in claim 8, further characterized by
(a) said force transmitting member being in flow communication with discharge ports arranged in said utilization device whereby said fluid under pressure may be discharged to a working surface contacted by the utilization device.

10. The means for discharging fluid under pressure to a working surface as set forth in claim 6, further characterized by
(a) said means for supplying fluid under pressure comprising a section tubing connecting a remote source of fluid to said motor housing,
(b) said passage-forming means comprising in part a hollow tubular portion in said output element, and
(c) a fluid flow chamber in said motor housing interconnecting said section of tubing and said hollow tubular portion of said output element.

11. The means for discharging fluid under pressure to a working surface as set forth in claim 10, further characterized by
(a) a bearing insert received in said motor housing for rotation therein about a central axis of the housing,
(b) said fluid flow chamber being defined by a spacing between said housing and said bearing insert,
(c) said bearing insert having an angularly disposed opening therethrough receiving a portion of the output element whereby the tubular portion of the output element is in flow communication with said chamber.

12. The means for discharging fluid under pressure to a working surface as set forth in claim 11, further characterized by
(a) said spacing being of sufficient dimension whereby said chamber and the tubular portion of the output element are in flow communication for the entire orbital cycle of the output element.

13. The means for discharging fluid under pressure to a working surface, as set forth in claim 11, further characterized by
(a) said spacing being of a small dimension whereby the tubular portion of the output element is in flow communication with the chamber for only a portion of its orbital cycle thereby providing a pulsating flow of water to the working surface, and
(b) one face of said rotating bearing insert sealing said chamber during the remaining portion of the orbital cycle of the output element.

14. The means for discharging fluid under pressure to a working surface, as set forth in claim 8, further characterized by
(a) said wobble plate being partially seated in a bearing support arranged in said housing,
(b) said means for supplying fluid under pressure comprising a flow passage means connecting a remote source of fluid to an opening in the housing communicating with surface of said bearing support, and
(c) said output element including an open end of the hollow tube in a confronting relation with the surface of the bearing support during a portion of the orbital cycle of the output element and being in alignment with said opening during the remaining portion of the orbital cycle,
(d) said wobble plate being in a sealing relation with said opening during the portion of the orbital cycle during which the output element is not in alignment with said opening.

15. In a fluid-driven nutating action appliance including a motor housing and a wobble plate mounted in said motor housing for universal tilting movement within predetermined limits, means for diverting a portion of the motive fluid to a utilization device, which comprises
(a) said wobble plate including a spherical bearing element,
(b) said motor housing including opposed bearing seats for said spherical element,
(c) fluid inlet and outlet passages communicating with said motor housing for driving said wobble plate,
(d) means in said motor housing forming a plenum cavity in the area of one of said bearing seats,
(e) first passage-forming means connecting said plenum cavity with one of said inlet or outlet passages,
(f) a tubular output element carried by said wobble plate and extending into said spherical bearing element,
(g) second passage-forming means in said spherical element for establishing communication between said tubular output element and said plenum cavity during nutating action motions of said wobble plate.

16. The appliance of claim 15, further characterized by
(a) said second passage-forming means describing an orbital path during nutating action motions of said wobble plate, and
(b) said orbital path falling at least partly outside the limits of said plenum chamber, whereby fluid is supplied to said second passage-forming means in a pulsating flow.

17. A fluid-driven nutating action appliance, which comprises
(a) a motor housing,
(b) a wobble plate mounted in said motor housing for universal tilting movement within predetermined limits, (c) a rod-like output element carried by said wobble plate and having at least one end projecting out of said motor housing, (d) a contact-type utilization device mounted on the projecting end of said output element, (e) said contact-type utilization device being movable through an orbital path in the absence of rotation, (f) said rod-like output element comprising a hollow tube, (g) means to supply fluid to the tube at a location remote from said utilization device, (h) flow passage means in said utilization device communicating with said tube, (i) said motor housing having a chamber therein communicating with the end of said tube remote from said utilization device, and (j) means for supplying fluid under pressure to said chamber.

18. A fluid-driven nutating action appliance according to claim 17, further characterized by (a) said chamber being of a size and shape to communicate with said tube during a limited portion only of the orbital cycle of said tube.

* * * * *